US005084117A

United States Patent [19]

Houston et al.

[11] Patent Number: 5,084,117

[45] Date of Patent: Jan. 28, 1992

[54] EXPLOSIVE

[75] Inventors: Richard C. M. Houston; Julian Taylor, both of Johannesburg, South Africa

[73] Assignee: AECI Limited, Johannesburg, South Africa

[21] Appl. No.: 691,410

[22] Filed: Apr. 25, 1991

[30] Foreign Application Priority Data

Apr. 27, 1990 [ZA] South Africa ..... 90/3248

[51] Int. Cl.[5] ..... C06B 45/00

[52] U.S. Cl. ..... 149/2; 149/21; 149/46; 149/61; 149/109.6

[58] Field of Search ..... 149/2, 21, 46, 61, 109.6

[56] References Cited

U.S. PATENT DOCUMENTS 4,357,184 11/1982 Binet et al. ..... 149/2
4,960,475 10/1990 Cranney et al. ..... 149/2
4,994,124 2/1991 Nguyen ..... 149/21

*Primary Examiner*—Stephen J. Lechert, Jr.
*Attorney, Agent, or Firm*—Cushman, Darby & Cushman

[57] ABSTRACT

This invention relates to an explosive. It relates in particular to the manufacture of an emulsion explosive comprising a discontinuous phase which forms an oxidizing salt-containing component and a continuous phase which is immiscible with the discontinuous phase and which forms a fuel component.

16 Claims, No Drawings

EXPLOSIVE

Such explosives, when the oxidizing salt-containing component contains water and is in the form of an aqueous solution, are known as "water-in-fuel" or "water-in-oil" emulsions, and when the oxidizing salt component contains little or no water, they can be regarded as "melt-in-fuel" or "melt-in-oil" emulsions.

According to the invention, in the manufacture of an explosive in the form of a water-in-oil emulsion comprising a discontinuous phase which forms an oxidizing salt-containing component and a continuous phase which is immiscible with the discontinuous phase and which forms a fuel component, there is provided a method of sensitizing the explosive to detonation which comprises dispersing in the emulsion an aqueous gassing solution comprising a chemical gassing agent and a water-soluble or water-miscible organic compound capable of promoting the formation of gas bubbles in the emulsion, to form an emulsion having a density at atmospheric pressure of 0,80–1,30 g/cm$^3$ at 25° C.

Suitable water-soluble or water-miscible organic compounds, which are capable of promoting the formation of gas bubbles in the emulsion, do not react with the chemical gassing agent, are compatible with the emulsion and are capable of reducing the interfacial tension between the gassing solution and the emulsion oil phase.

The water-soluble or water-miscible organic compound may be selected from the group comprising glycols, alcohols, ethers, amides, amines and sugars. Preferably the water-soluble or water-miscible organic compound is selected from the group comprising ethylene glycol, methanol, formamide, methylamine and sucrose. A particularly suitable compound has been found to be ethylene glycol.

Alternatively, the water-soluble or water-miscible organic compound may be selected from the group comprising anionic and synperonic dispersants. Examples of such dispersants are dioctyl sulphosuccinate and nonyl phenol ethoxylate.

In a particular embodiment of the invention, the discontinuous phase preferably comprises, at least in part, ammonium nitrate, in which case a chemical gassing agent comprising nitrite ions, eg sodium nitrite, may be employed, conveniently in the form of an aqueous solution of 2%–50% m/m concentration, which is blended into the emulsion.

As soon as blending is initiated, nitrite ions start to react with ammonium ions in accordance with the equation $$NO_2 + NH_4 \rightarrow N_2 + 2H_2O$$

to produce nitrogen bubbles.

The amount of sodium nitrite used will depend on the proportion or number of bubbles required, ie on the eventual density required for the explosive, and, if desired, one or more catalysts such as thiourea, thiocyanate or urea may be dissolved into the discontinuous phase prior to said blending, to accelerate the nitrite ion/ammonium ion reaction. Catalysts such as the thiocyanate ion may also be added to the nitrite-containing gassing solution.

The optimum amount of the water-soluble or water-miscible organic compound present in the gassing solution may be determined by routine experimentation. Typically, the water-soluble or water-miscible organic compound constitutes from 2% to 50% m/m of the gassing solution and in the case of ethylene glycol the Applicant has found that a sodium nitrite solution containing 10% m/m ethylene glycol gives good results.

The discontinuous phase of the emulsion may comprise at least one oxidizing salt selected from the group comprising ammonium nitrate, alkali metal nitrates, alkaline earth metal nitrates, ammonium perchlorate, alkali metal perchlorates, and alkaline earth metal perchlorates.

The discontinuous phase may comprise ammonium nitrate with at least one further compound selected from the group consisting of oxygen-releasing salts and fuels which, together with the ammonium nitrate, forms a melt which has a melting point which is lower than that of the ammonium nitrate. Said further compound may be sodium nitrate, calcium nitrate, urea, urea derivatives such as thiourea, or the like.

The fuel component of the emulsion may form from 2% to 25% by mass of the emulsion, preferably about 3% to 12% by mass.

The fuel component comprises a water-immiscible organic phase component and forms the continuous "oil" phase of the water-in-oil emulsion explosive. Suitable organic fuels include aliphatic, alicyclic and aromatic compounds and mixtures thereof which are in the liquid state at the formulation temperature. Suitable organic fuels may be selected from the group comprising fuel oil, diesel oil, distillate, kerosene, naphtha, waxes (eg. microcrystalline wax, paraffin was and slack wax), paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are liquid hydrocarbons generally referred to as petroleum distillates such as kerosene, fuel oils and paraffin oils.

The fuel may comprise an oil-soluble emulsifier or a mixture of suitable oil-soluble emulsifiers. The fuel component may thus comprise at least one emulsifier selected from a wide range of emulsifying agents known in the art for the preparation of water-in-oil emulsion explosive compositions. The oil-soluble emulsifier may be selected from the group comprising sorbitan sesquioleate, sorbitan monoleate, sorbitan monopalmitate, sodium monostearate, sodium tristearate, the mono- and diglycerides of fat-forming fatty acids, soya bean lecithin, derivatives of lanolin, alkyl benzene sulphonates, oleyl acid phosphate, laurylamine acetate, decaglycerol decaoleate, decaglycerol decastearate, 2-oleyl-4,4'-bis(-hydroxymethyl)-2-oxazoline, polymeric emulsifiers containing polyethylene glycol backbones with fatty acid side chains and derivatives of polyisobutylene succinic anhydride. The emulsifiers act as surfactants and stabilizers to promote the formation of the emulsion and to resist crystallization and/or coalescence of the discontinuous phase.

If desired, the fuel component may comprise other optional fuel materials, hereinafter referred to as secondary fuels, in addition to the water-immiscible organic fuel phase. Examples of such secondary fuels include finely divided solid materials such as aluminum and silicon, typically added in amounts ranging from 0% to 20% by mass of the emulsion.

The method of the invention may further comprise mixing into the formed water-in-oil emulsion an amount of material which is an oxidizing salt or which in its own right is an explosive material. Typically, there is added to and mixed with the water-in-oil emulsion up to 90% m/m of an oxidizing salt such as ammonium nitrate or an explosive material comprising a mixture of an oxidizing salt such as ammonium nitrate and fuel oil and commonly referred to by those skilled in the art as "ANFO". The compositions of "ANFO" are well known and have ben described at length in the literature relating to explosives. It also lies within the method of the invention to incorporate as a further explosive component of the water-in-oil emulsion well-known explosive materials comprising one or more of for example trinitrotoluene, nitroglycerine or pentaerythritol tetranitrate.

Typically, the gassing solution is dispersed in the emulsion by subjecting the gassing solution and the emulsion to mixing and shear. Any mixing device which provides the desired degree of mixing and shear can be used, for example a beater-bar mixer, a pump and auger arrangement, a non-return valve, orifice plate or static mixer with or without a check valve homogenizer. The gassed emulsion may be cartridged or fed through a loading hose into a borehole.

It is desirable for the explosive to contain evenly distributed gas bubbles in the emulsion of an average size [diameter] in the range 50–100, eg 75, microns, and to have bubbles of a relatively uniform size, ie a relatively narrow bubble size distribution. The desired bubble size and bubble size distribution can be promoted by employing the method of the present invention.

The invention extends also to an explosive whenever manufactured according to the method described above.

The invention will now be described, by way of illustration, with reference to the following non-limiting Examples.

EXAMPLES 1–3

Three emulsion explosive formulations were prepared in accordance with the present invention, as set out hereunder, in which compositions are expressed as percentages on a mass basis:

| | EXAMPLE 1 % m/m | EXAMPLE 2 % m/m | EXAMPLE 3 % m/m |
|---|---|---|---|
| Base Emulsion | | | |
| Ammonium nitrate | 52,0 | 77,0 | 29,4 |
| Calcium nitrate | 22,5 | Nil | 22,0 |
| Ammonium nitrate prills | Nil | Nil | 30,0 |
| Water | 20,0 | 17,0 | 12,0 |
| Sorbitan sesquioleate | 1,0 | 1,0 | 1,0 |
| Mineral oil P95 | 2,0 | Nil | Nil |
| Diesel oil | 2,0 | 4,9 | 5,3 |
| Thiourea | 0,4 | 0,05 | 0,2 |
| Acetic acid | 0,1 | 0,05 | 0,1 |
| TOTAL | 100,0 | 100,00 | 100,0 |
| pH | 3,8 | 4,7 | 4,0 |
| Gassing Solution | | | |
| Sodium nitrite | 3,0 | 25,0 | 25,0 |
| Ethylene glycol | 10,0 | 10,0 | 10,0 |
| Water | 87,0 | 65,0 | 65,0 |
| TOTAL | 100,0 | 100,00 | 100,0 |
| Cold density ($g/cm^3$) | 1,00 | 1,00 | 1,10 |

With regard to the constituents of the base emulsions, the ammonium nitrate and calcium nitrate, together with the water and minor ingredients thiourea and acetic acid, formed the discontinuous phase; the sorbitan sesquioleate (emulsifier) was Crill 43 obtained from Croda Chemicals [South Africa] [Proprietary] Limited; and the mineral oil P95 was obtained from BP South Africa [Proprietary] Limited.

In each case, a base emulsion was prepared by forming a first premix of water, ammonium nitrate, calcium nitrate (Examples 1 and 3 only), and thiourea at about 80° C. to 90° C. and acetic acid was added to adjust the pH to the specified value. A second premix of the diesel oil (and in Example 1 P95 oil) and Crill 43 was formed at about 20° C. The first premix was then added to the second premix with agitation to form the base emulsion.

In each case, a gassing solution was formed by mixing the sodium nitrite, the ethylene glycol and the water together.

The gassed emulsion of Example 1 was prepared by mixing together the base emulsion and 1,5% m/m of the gassing solution by pumping them at 50 kg / minute through a hose of 25 mm internal diameter into a check-valve homogenizer with a pumping pressure of 2500 kPa to form a product of the specified density. The gassed emulsion contained much smaller gas bubbles and the mixing was more uniform through the emulsion compared with a gassed emulsion prepared using the gassing solution without added ethylene glycol. In particular, samples of the product had a gas bubble size of from about 10 microns to 200 microns. The average bubble size was about 75 microns. The pumping pressure, which normally with this type of mixer is a major factor determining the gas bubble size, had less of an effect than when a gassed emulsion was prepared using the gassing solution without added ethylene glycol. When the pumping pressure was reduced to 1500 kPa, the average bubble size remained the same although the largest bubble observed was about 300 microns in diameter.

The gassed emulsion of Example 2 was prepared by mixing together the base emulsion and 0,25% m/m of the gassing solution using a beater-bar mixer to from a product of the specified density. As in Example 1, the gassed emulsion contained much smaller gas bubbles and the mixing was more uniform through the emulsion compared with a gassed emulsion prepared using the gassing solution without added ethylene glycol.

The base emulsion of Example 3 was mixed with 30% m/m of solid ammonium nitrate prills and a gassed doped emulsion was prepared by mixing together the ammonium nitrate prill-containing base emulsion and 0,2% m/m of the gassing solution using a pump and auger arrangement to form a product of the specified density. As in Examples 1 and 2, the presence of ethylene glycol in the gassing solution promoted the formation of very small gas bubbles and uniform mixing.

A problem in methods known to the Applicant for mixing a chemical gassing solution with a water-in-oil base emulsion is that a lot of shear is required to provide the optimum gas bubble size of 50 to 100 microns in the gassed emulsion. This shear can have detrimental effects on the emulsion itself, reducing its stability and a lot of power and high pressures may be required to input the shear. Such power and high pressure simply may not be available, for example on a loading mobile unit, and in practice the product is often loaded with too large a gas bubble size. It is an advantage of the invention compared with the above-mentioned methods that less shear is required to form a gassed emulsion having the optimum gas bubble size.

We claim:

1. In the manufacture of an explosive in the form of water-in-oil emulsion comprising a discontinuous phase which forms an oxidizing salt-containing component and a continuous phase which is immiscible with the discontinuous phase and which forms a fuel component, a method of sensitizing the explosive to detonation which comprises dispersing in the emulsion an aqueous gassing solution comprising a chemical gassing agent and a water-soluble or water-miscible organic compound capable of promoting the formation of gas bubbles in the emulsion, to form an emulsion having a density at atmospheric pressure of 0,80–1,30 g/cm$^3$ at 25° C.

2. A method according to claim 1, in which the water-soluble or water-miscible organic compound is selected from the group comprising glycols, alcohols, ethers, amides, amines and sugars.

3. A method according to claim 2, in which the water-soluble or water-miscible organic compound is selected from the group comprising ethylene glycol, methanol, formamide, methylamine and sucrose.

4. A method according to claim 2, in which the water-soluble or water-miscible compound is ethylene glycol.

5. A method according to claim 1, in which the water-soluble or water-miscible organic compound is selected from the group comprising anionic and synperonic dispersants.

6. A method according to claim 5, in which the water-soluble or water-miscible organic compound is selected from the group comprising di-octyl sulphosuccinate and nonyl phenol ethoxylate.

7. A method according to claim 1, in which the chemical gassing agent is sodium nitrite, the discontinuous phase containing ammonium nitrate.

8. A method according to claim 7, in which the aqueous gassing solution comprises a 2%–50% m/m aqueous solution of sodium nitrate.

9. A method according to claim 8, in which the aqueous gassing solution comprises 2%–50% m/m of the water-soluble or water-miscible organic compound.

10. A method according to claim 1, in which the discontinuous phase comprises at least one oxidizing salt selected from the group comprising ammonium nitrate, alkali metal nitrates, alkaline earth metal nitrates, ammonium perchlorate, alkali metal perchlorates, and alkaline earth metal perchlorates.

11. A method according to claim 1, in which the discontinuous phase comprises ammonium nitrate with at least one further compound selected from the group consisting of oxygen-releasing salts and fuels which, together with the ammonium nitrate, forms a melt which has a melting point which is lower than that of the ammonium nitrate.

12. A method according to claim 11, in which said further compound is selected from the group comprising sodium nitrate, calcium nitrate, urea and urea derivatives.

13. A method according to claim 1, in which the fuel component comprises an organic fuel selected from the group comprising fuel oil, diesel oil, distillate, kerosene, naphtha, waxes, paraffin oils, benzene, toluene, xylenes, asphaltic materials, polymeric oils, animals oils, fish oils, and other mineral, hydrocarbon or fatty oils, and mixtures thereof.

14. A method according to claim 1, in which the fuel component comprises at least one oil-soluble emulsifier selected from the group comprising sorbitan sesquioleate, sorbitan monooleate, sorbitan monopalmitate, sodium monostearate, sodium tristearate, the mono- and diglycerides of fat-forming fatty acids, soya bean lecithin, derivatives of lanolin, alkyl benzene sulphonates, oleyl acid phosphate, laurylamine acetate, decaglycerol decaoleate, decaglycerol decastearate, 2-oleyl-4,4'-bis(-hydroxymethyl)-2-oxazoline, polymeric emulsifiers containing polyethylene glycol backbones with fatty acid side chains and derivatives of polyisobutylene succinic anhydride.

15. A method according to claim 1, which comprises mixing into the formed water-in-oil emulsion an amount of material which is an oxidizing salt or which in its own right is an explosive material.

16. An explosive whenever manufactured according to the method of claim 1.

* * * * *